US005829084A

United States Patent [19]

Fujiwara

[11] Patent Number: 5,829,084

[45] Date of Patent: Nov. 3, 1998

[54] METHOD AND SYSTEM FOR BALANCING AN UPRIGHT WASHING MACHINE

[76] Inventor: Leslie H. Fujiwara, P.O. Box 771, Kealakekua, Hi. 96750

[21] Appl. No.: 867,575

[22] Filed: Jun. 2, 1997

[51] Int. Cl.[6] ..... D06F 37/24

[52] U.S. Cl. ..... 8/158; 68/12.06; 68/23.2; 74/573 F; 210/144

[58] Field of Search ..... 8/158; 68/12.06, 68/23.2; 210/144; 74/573 F

[56] References Cited

U.S. PATENT DOCUMENTS

| | | | |
|---|---|---|---|
| 2,463,801 | 3/1949 | Page | 68/23.2 |
| 2,534,267 | 12/1950 | Kahn | 74/573 F |
| 2,647,386 | 8/1953 | Keiper | 68/23.2 |
| 2,769,383 | 8/1956 | De Moss | 74/573 F |
| 3,060,713 | 10/1962 | Burkall | 68/23.2 |
| 3,066,522 | 12/1962 | Steinmuller | 68/23.2 |
| 3,283,547 | 11/1966 | Severance | 68/12.02 |
| 3,330,168 | 7/1967 | Kahn | 74/573 F |
| 4,528,827 | 7/1985 | Largen | 68/23.2 |
| 5,280,660 | 1/1994 | Pellerin et al. | 8/158 |

*Primary Examiner*—Philip R. Coe
*Attorney, Agent, or Firm*—Donna J. Thies

[57] ABSTRACT

A method and system for balancing a load in an upright washing machine. A liquid ballast system is used that includes liquid filling channels with liquid filling slots that fill individual self-contained cells spaced equally around the top rim of the spin drum. The cells are open at the top and filled with liquid, water, by the pre-existing water supply nozzle of the washing machine. In the bottom of each cell is a dump valve to release water from the cell when activated. A stationary ring attached to the frame of the washing machine activates the dump valve. In a mechanical embodiment, a mechanical arm makes contact with the stationary ring when the suspended core of the washing machine leans off center in response to an unbalanced load. In an electrical embodiment, a solenoid valve is activated when a contact point makes electrical contact with a track in the stationary ring as the suspended core of the washing machine leans off center in response to an unbalanced load. A method for balancing the load in an upright washing machine is also disclosed.

20 Claims, 4 Drawing Sheets

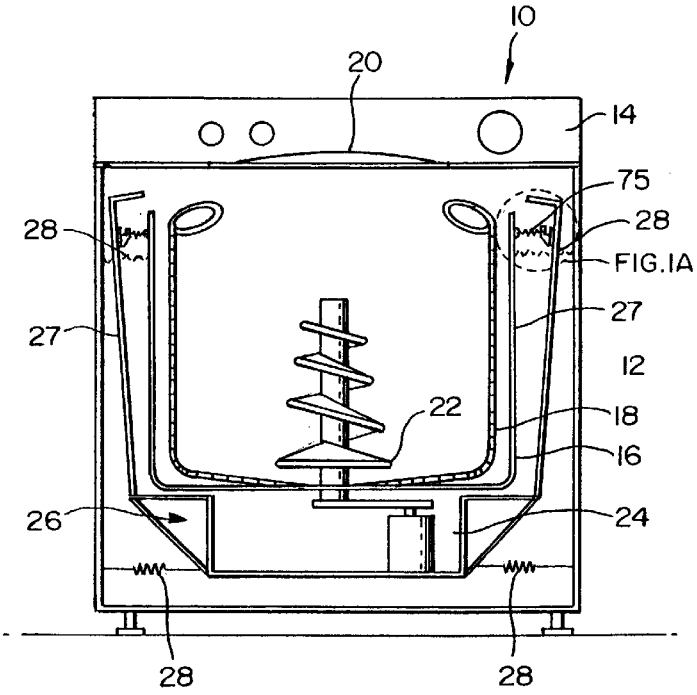
FIG. 1
FIG. 1A
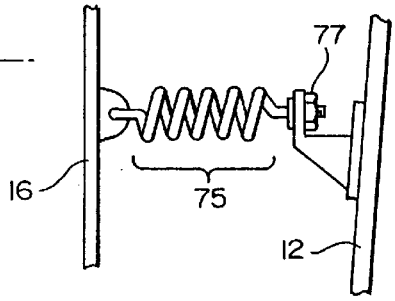
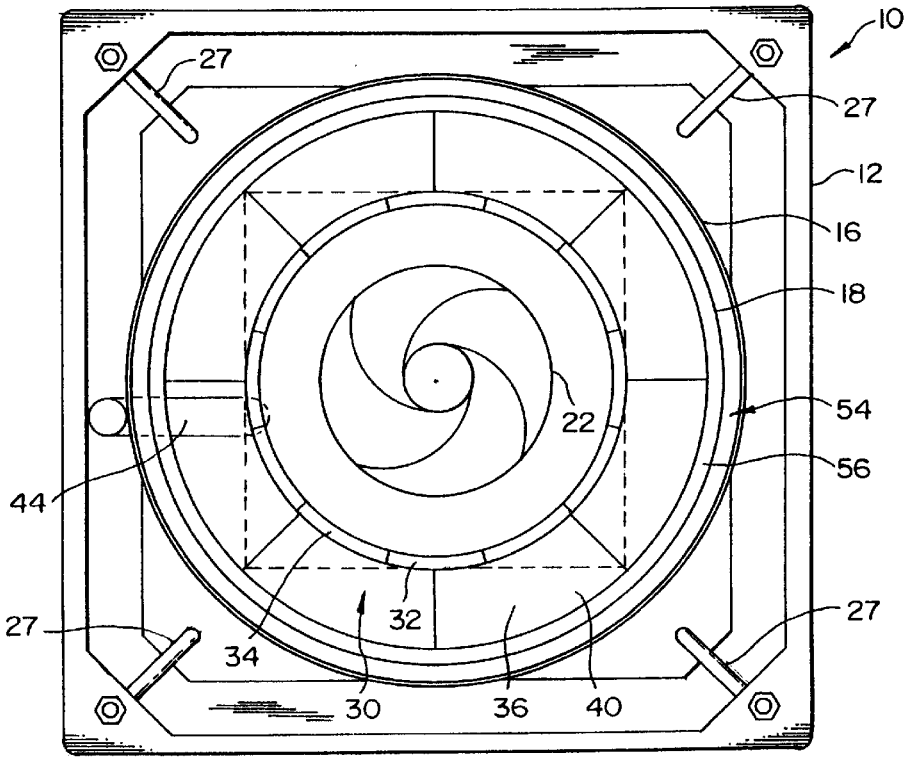
FIG. 2

FIG. 4
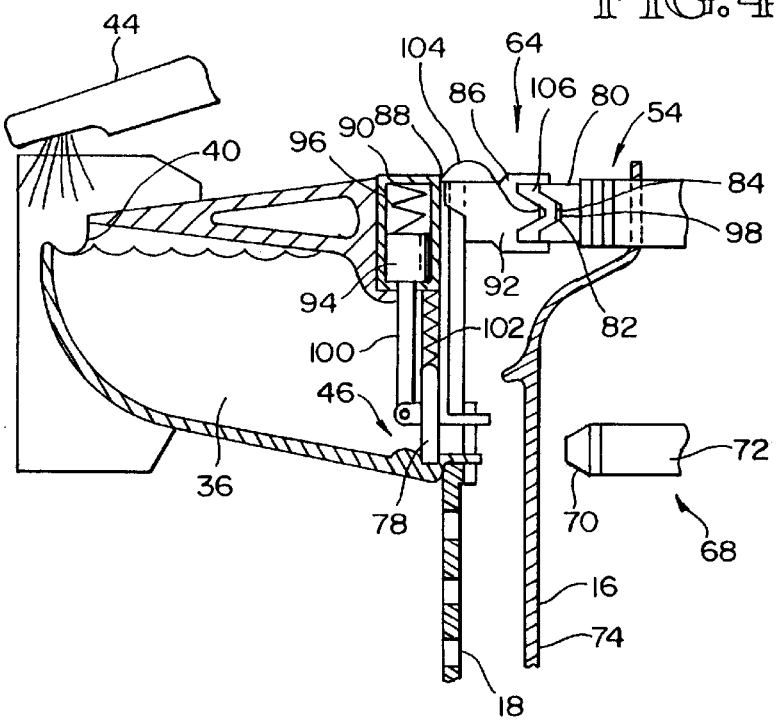
FIG. 6
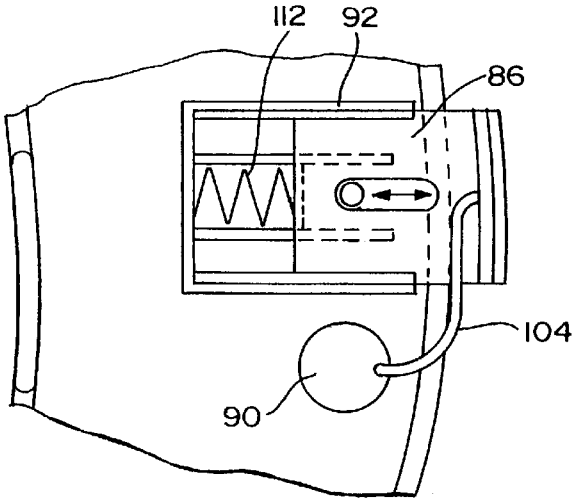
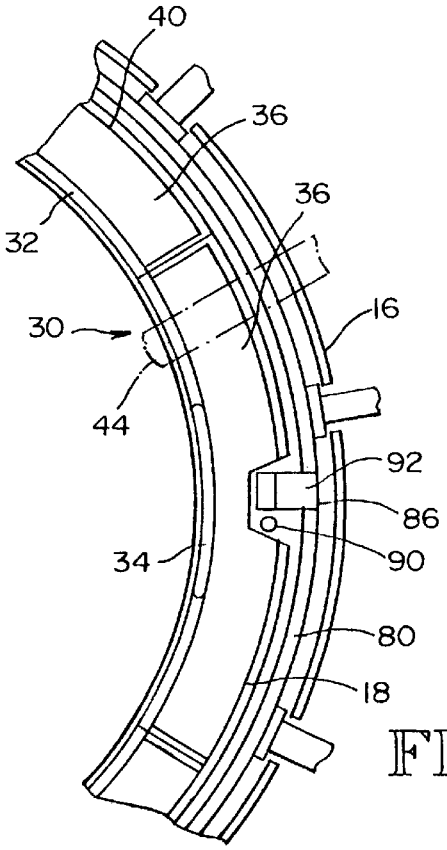
FIG. 5

METHOD AND SYSTEM FOR BALANCING AN UPRIGHT WASHING MACHINE

BACKGROUND OF THE INVENTION

A common problem that has prevailed since the introduction of the upright washing machine is that often, particularly with small or one item loads of clothes, more clothes end up distributed on one side of the washing machine than the other. As the spin cycle commences this results in heavy vibrations of the washing machine until the washing machine stops. At this point, the user must manually redistribute the load of washing and restart the washing machine to finish the washing machine cycles. This is very inconvenient for the user and hard on the life of the washing machine. What is desired is a system, internal to the washing machine, that does not require human intervention, that balances the washing load so that interruption of the washing machine cycles does not occur, even with small loads.

U.S. Pat. No. 2,534,267 to Kahn discloses a washing machine cylinder balancing apparatus that corrects unbalance in the cylinder of a washing machine by the centrifugal extraction of water.

U.S. Pat. No. 2,760,383 to De Moss discloses a balancing means for a rotating container which injects liquid in jet form into counterbalancing pockets spaced equidistantly from the center of the drum.

U.S. Pat. No. 3,060,713 to Burkall describes a front loading washing machine with liquid balancing pockets.

U.S. Pat. No. 3,066,522 to Steinmuller discloses a front loading washing machine with water filled chambers that are selectively emptied to rebalance an unbalanced load.

U.S. Pat. No. 3,283,547 to Severance teaches a speed control for a front loading laundry machine that also has liquid balancing pockets.

U.S. Pat. No. 3,330,168 to Kalen describes a balancing system for a washing machine that is mounted to the outside of the cylinder so that space is not taken up within the cylinder.

U.S. Pat. No. 4,528,827 to Largen discloses an extractor drum balancer with water holding receptacles.

U.S. Pat. No. 5,280,660 to Pellerin et al. discloses a front loading washing machine with a balancing system which electronically detects the magnitude and location of an unbalanced load and injects balancing fluid into hollow balancing compartments.

SUMMARY OF THE INVENTION

In order to overcome problems inherent in the prior art, there has been devised by the present invention, an improved balancing system for an upright washing machine. The present invention uses a liquid ballast system that includes a liquid filling means in the form of a channel with liquid filling slots that fill a liquid holding means in the form of individual, self-contained cells equally distributed around the top rim of the spin drum. The cells are open at the top and are filled with liquid, water in the present instance, by the pre-existing water supply nozzle during the filling cycle of the washer. Within each ballast cell at its bottom portion there is a dumping means in the form of a valve to release water from the cell when activated. A balancing means in the form of a stationary ring that is attached to the frame, parallel to the upper part of the cell works with the dump valve to maintain achieved balance. In a mechanical dump valve embodiment, the ring has an inner part or race that rotates when a contact means in the form of a mechanical arm makes contact with the ring. In an electrically operated embodiment of the dump valve, the stationary ring is in the same position, but has an electrical conducting track built into the ring to receive contact points eventually leading to and activating the solenoid valve. Thus, when an unbalanced load causes the suspended core of the machine to lean off center on the heavy side of the drum, a contact point makes contact with the ring thereby actuating the dump valve and releasing the water ballast above the unbalanced load. The loss of weight over the heavy side achieves a balance that causes the suspended core to return to its upright position, thereby breaking contact with the ring and closing the dump valve to maintain the achieved balance. A stop means in the form of rubber bumpers is also provided on each embodiment to limit how far off center the alignment of the washer core is permitted to deviate.

It is therefore an object and advantage of the present invention to provide a balancing system for an upright washing machine that does not require human intervention to work.

It is another object and advantage of the present invention to provide a balancing system for an upright washing machine that is internal to the washing machine.

It is yet another object and advantage of the present invention to provide a balancing system for an upright washing machine that is simple and inexpensive in its manufacture.

It is still yet another object and advantage of the present invention to provide a balancing system for an upright washing machine that does not interfere with the capacity of the washing machine.

It is still yet another object and advantage of the present invention to provide a balancing system for an upright washing machine that can be installed as an add on feature to an existing upright washing machine without altering the basic design or capabilities of the washing machine.

BRIEF DESCRIPTION OF THE DRAWINGS

FIG. 1 is a lateral cross-sectional view of a conventional upright washing machine showing the interior of the washing machine.

FIG. 1A is an enlarged lateral cross-sectional view taken from FIG. 1 of the adjustable spring mechanism of the present invention that replaces the existing springs in the interior of the washing machine.

FIG. 2 is a top plan view of a conventional upright washing machine showing the improvements of the present invention.

FIG. 4 is a side cross-sectional view detailing the second preferred electrical embodiment of the present invention.

FIG. 5 is a top plan view showing the channels of the first and second preferred embodiments and detailing the contact unit of the second preferred embodiment.

FIG. 6 is an enlarged detail top plan view showing detail of the contact unit of the second preferred embodiment of the present invention.

DESCRIPTION OF THE PREFERRED EMBODIMENTS

Figure 3:
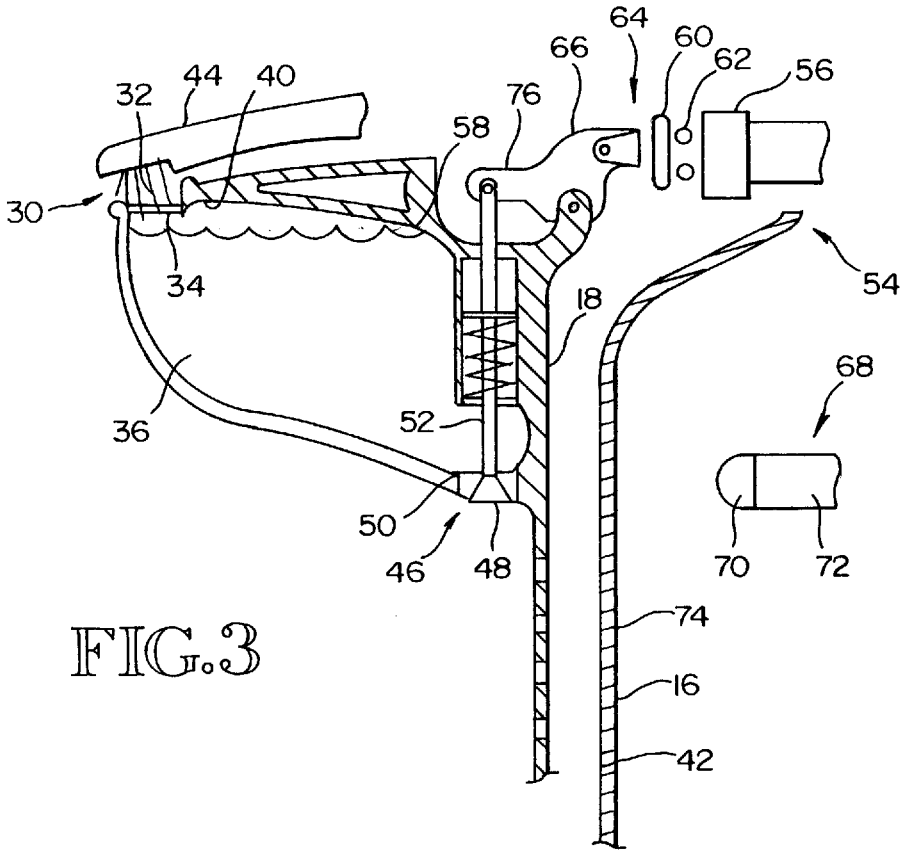
FIG. 3 is a side cross-sectional view detailing the first preferred mechanical embodiment of the present invention.

Referring now to the drawings in general and in particular to FIG. 1 of the drawings there is shown a lateral cross-sectional view of a conventional upright washing machine. The upright washing machine is shown generally by the number 10. The washing machine generally comprises a frame 12, a control panel 14, a tub 16 that does not rotate and a perforated spin drum 18 within the tub 16 that accomplishes the spin cycle of the washing machine 10. In an upright, top loading, washing machine 10 a door 20 is positioned on top of the frame 12 for inserting and removing laundry. Also, within the washing machine 10 there is an agitator 22 and a combination transmission/pump and electric motor unit 24. The spin drum 18, tub 16, agitator 22 and combination motor unit 24 comprise a core 26 that is suspended within the frame 12 with rods 27 and springs 28 that absorb moderate vibrations. Ordinarily, during the spin cycle, when the washing machine 10 has an unbalanced load, the suspended core 26 of the machine 10 leans off center on the heavy side of the drum 18 and starts to vibrate as r.p.m.s. increase until the machine 10 is shut down automatically by a vibration overload switch thereby remaining idle until the load is rebalanced by hand and restarted.

The balancing system 29 for an upright washing machine 10 of the present invention uses a liquid or water ballast or weighting system. The system 29 comprises water filling means 30 in the form of a channel 32 with water filling slots 34 that fill a plurality of individual, self-contained cells 36 that are equally distributed around the top rim 38 of the spin drum 18 of the washing machine 10 as seen most clearly in FIGS. 2, 3 and 5. The cells 36 are open at their top ends 40 and are filled with water via the channel 32 that encircles the interior 42 of the spin drum 18 and interconnects the cells 36. The channel 32 is positioned through all the ballast cells 36, and water filling slots 34 within the channel 32 allow water into each ballast cell 36. The pre-existing water supply nozzle 44 of the washing machine 10 is positioned to direct part of its water spray into the channel 32 so that the ballast cells 36 are replenished during the fill cycle of the washing machine 10, with surplus water continuing into the tub 16 as seen most clearly in FIGS. 3 and 4. If the ballast cells 36 were not dumped during the previous washing cycle, some water may remain in the cell 36. In this event, there is less water diverted to that cell 36 and more surplus water continues into the tub 16 filling it faster. Within each ballast cell 36 there is a dumping means 46 in the form of a dump valve 48 at the bottom 50 of the cell 36 to release water from the cell 36 when activated.

In the first preferred embodiment of the present invention, the dumping means 46, in the form of a mechanical dump valve 52, as shown in FIG. 3, is used to release water from the cells 36. FIG. 3 is a side cross-sectional view detailing the first preferred mechanical embodiment of the present invention. A balancing means 54 in the form of a stationary ring 56 that is attached to the frame 12 parallel to the upper portion 58 of the cells 36 works with the dump valve 48 to maintain achieved balance. In the first preferred embodiment of the present invention using a mechanical dump valve 52 as shown in FIG. 3, the stationary ring 56 has an inner portion or race 60, having ball bearings 62, that rotate when a contact means 64, in the form of a mechanical arm or valve activator 66 makes contact with the stationary ring 56. Thus, in the first preferred embodiment of the present invention using a mechanical dump valve 52, as the washing and rinsing cycles are commenced, the cells 36 are filled with water via the channel 32. A heavy load of laundry below the cell 36 will cause the tub 16 and drum 18 to shift outwardly during the spin cycle. As the spin drum 18 shifts outwardly, the valve actuator 66 also moves outwardly to engage and rotate the ball bearings 62 and hence the inner portion or race 60 of the stationary ring 56. The movement of the valve activator 66 outwardly also causes the dump valve 52 to open, releasing water above the heavy load of laundry beneath the cell 36. The extra water released over the heavy side of the laundry load causes a loss of weight over the heavy side, thereby achieving a balance that causes the suspended core 26 of the washing machine 10 to return to its upright position as seen in FIG. 1. At this point, the valve actuator 66 thereby breaks contact with the stationary ring 56, thus closing the mechanical dump valve 52 to maintain the achieved balance.

In the first preferred embodiment of the present invention, stop means 68 in the form of stationary rubber bumpers 70 are attached by a bracket 72 to the frame 12 of the washing machine 10 outside the exterior perimeter 74 of the tub 16. The bumpers 70 limit how far off center the alignment of the washer core 26 is permitted to deviate and thus prevent damage to the stationary ring 56 and other mechanical parts under extreme unbalance conditions. The rubber bumpers 70 therefore are not used for the majority of off balance loads. Since, while centrifugal force moves the valve actuator 66 outwardly it is also pushing against the ballast cell 36 and will accelerate the movement of the water through the ballast cell 36 and the dump valve 52, so that most loads will allow the dumping of the ballast cell 36 quickly enough to arrest the outward motion of the tub 16. So, in the first preferred embodiment, when the valve actuator 66 is in neutral, with no force acting upon it, the mechanical dump valve 52 is in the closed position with a corresponding upright position of the suspended core 26 as seen in FIG. 1. The bumpers 70 are positioned so that the centrifugal force that pushes the valve actuator 66 into the stationary ring 56 will thus move the arm 76 of the valve actuator 66 inwardly. A movement allowance of the arm 76 of the valve actuator 66 is calculated as the measurement between the arm 76 of the valve actuator 66 and the stationary ring 56 plus the distance that the arm 76 of valve actuator 66 travels from the closed position to the fully open position of the dump valve 48 minus a safety factor of ¼ inch. This would limit the distance travelled by the arm 76 of the valve actuator 66 short of the fully open position of the dump valve 48. Since the inward movement of the arm 76 of the valve actuator 66 must not exceed the pivotal arc distance to the fully open position of the dump valve 48, the bumper 70 is positioned at the movement allowance from the at rest centered tub position to allow safety of mechanical parts under unusually heavy off balanced load conditions. The first preferred mechanical embodiment of the balancing system 29 of the present invention is also equipped with an adjustable spring mechanism 75, as seen in FIG. 1 and in more detail in FIG. 1A, used to replace the existing springs 28 on the washing machine 10. The adjustable spring mechanism 75 of the present invention is stronger than the existing springs 28 on the washing machine 10 to keep the suspended core 26 from swinging too forcefully against the stop means 68. The adjustable spring mechanism 75 can also be adjusted using the adjusting means 77, to have the proper tension during the assembly, maintenance and testing of the present balancing system 29.

FIG. 4 is a side cross sectional view detailing the second preferred electrical embodiment of the present invention. In the second preferred embodiment of the present invention utilizing a dumping means 46 in the form of an electrically operated dump valve 78, and a balancing means 54 in the form of a stationary ring 80, the stationary ring 80 is in the same position as the stationary ring 56 of the first preferred mechanical embodiment of the dump valve 52 as seen in FIG. 3. However, the stationary ring 80 of the second preferred electrical embodiment has a recessed inside face 82 with an electrical conducting track 84 to receive electrical contact from a contact unit 86 on the spin drum 18 which leads to a contact point 88 on the dumping means 46. In the second preferred electrical embodiment of the present invention, the dumping means 46 in the form of an electrical dump valve 78 is a solenoid valve 90. The stationary ring 80 is constructed of non-conducting material to minimize exposure to the electrical conducting track 84 and the contact unit 86 on the spin drum 18 is positioned in a housing 92 for general electrical safety. The contact unit 86 on the spin drum 18, as seen most clearly in FIG. 6, is an electrical unit that activates the solenoid valve 90 to the open position when current is applied to the valve 90. The solenoid valve 90 of the second preferred embodiment as seen most clearly in FIG. 4, is a combination valve 94 and coil of wire 96 that acts like a magnet when the wire 96 carries a current. When the solenoid coil of wire 96 is off or de-energized the valve portion 94 of the solenoid valve 90 is in closed mode thereby maintaining an achieved balance as described hereinafter. When there is an unbalanced load in a particular part of the spin drum 18 of the washing machine 10, in the second preferred embodiment, the spin drum 18 moves off center from the heavy load toward the stationary ring 80 as in the first preferred embodiment. The off center movement of the spin drum 18 causes the contact unit 86 on the spin drum 18 to touch a first contact point 98 on the electrical conducting track 84 of the stationary ring 80. Since the solenoid valve 90 is grounded to the spin drum 18, when the contact unit 86 on the spin drum 18 touches the first contact point 98 on the electrical conducting track 84 of the stationary ring 80, current is applied from the stationary ring 80 back to the second contact point 88 on the solenoid valve 90 and current is therefore applied to the coil portion 96 of the solenoid valve 90, activating it. When the coil portion 96 of the solenoid valve 90 is energized it creates a magnetic field such that an iron rod 100 is pulled upward toward a top magnetic pole, thereby compressing a spring 102 and opening the valve 94 to release water from the ballast cell 36. So, the activated coil portion 96 of the solenoid valve 90 forces the movement of the iron rod 100 which opens the valve portion 94 of the solenoid valve 90. The valve portion 94 of the solenoid valve 90 and hence the dump valve 78 open because the solenoid valve 90 is grounded to the spin drum 18 which in turn is grounded to the suspended core 26 of the washing machine 10. Since the entire suspended core 26 of the washing machine 10, as seen in FIG. 1, is grounded, only one pole contact is required to complete the circuit to activate the solenoid valve 90. The contact unit 86 is aligned with the electrical conducting track 84 so that the electrical conducting track 84 receives the contact unit 86 to energize the solenoid 90 through an electrical conducting cable 104. When the unbalanced load in the spin drum 18 forces the washer core 26 to move off center from the heavy side of the spin drum 18, the contact unit 86 mates with the electrical conducting track 84 thereby opening the valve 94 to release water to equalize the unbalanced load and return the spin drum 18 to the vertical center axis. This corrective movement separates the contact unit 86 from the electrical conducting track 84 and de-energizes the solenoid 90 closing the valve 94.

So, in place of the contact means 64 in the form of a valve actuator 66 that opens the dump valve 52 in the first preferred mechanical embodiment of the present invention, as seen in FIG. 3, there is provided in the second preferred electrical embodiment, as seen in FIG. 4, a contact means 64 generally in the form of the contact unit 86 on the spin drum 18, the first contact point 98 on the stationary ring 80 and the second contact point 88 on the solenoid valve 90. In the present invention, A.C. current is used because it provides a stronger solenoid and because it is readily available within the pre-existing washer electrical system, however, with minor modifications the use of D.C. current is within the spirit and scope of the present invention. In general, the contact unit 86 moves within its housing 92 against the spring 102 when there is centrifugal force on the unbalanced load during the rotation of the spin drum 18, to thereby close the gap 106 between the contact unit 86 and the first contact point 98 on the stationary ring 80 thus activating the solenoid valve 90. After contact is made between the contact unit 86 and the first contact point 98 on the stationary ring 80, the spin drum 18 continues to move outwardly from the center. The contact unit 86 on the spin drum 18 slides within its housing 92 and against the spring 102 to absorb the outward movement of the spin drum 18 after initial contact is made with the stationary ring 80. After the water ballast cell 36 is released and the quantity of water released is equal to the weight of the off balanced load, the suspended core 26 is restored to true vertical center, as seen in FIG. 1, and the spring 102 will thus return the contact unit 86 to the normal spaced position, with the gap 106 between the contact unit 86 and the contact point 98 on the stationary ring 80.

Figure 7:
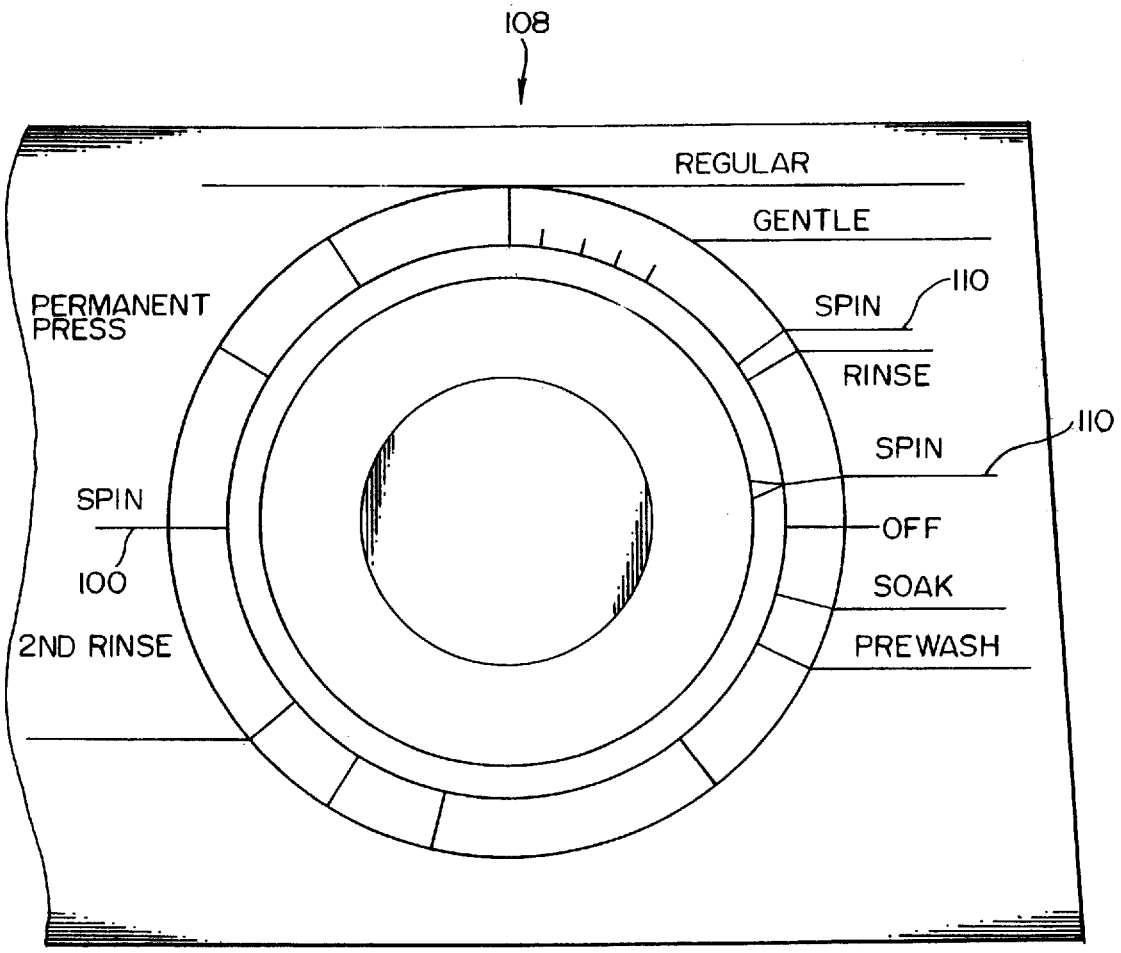
FIG. 7 is a front plan view of a control panel of a conventional washing machine showing the timer engaged to commence the spin cycle.

The A.C. electrical current to the solenoid actuated valve 90 is connected to a pre-existing location on the timing mechanism of the washing machine 10 where the timer 108 of the washing machine 10 starts the spin cycle 110, as shown in FIG. 7. Thus, the electrical conducting track 84 of the stationary ring 80 will activate the coil 96 of the solenoid valve 90 only during the spin cycle 110 of the washing machine 10 and the solenoid 90 is prevented from accidentally opening when the suspended core 26 is otherwise moved. It is within the spirit and scope of the invention to interrupt the timer 108 of the washing machine 10 for various periods of time. Also, opening the door 20 of the washer 10 not only shuts off power to the electric motor 24 of the washer 10 during the spin cycle, but also de-energizes the electrical current to the present dump valve system. In addition, the contact unit 86 on the spin drum 18 is recessed and in its housing 92 for general electrical safety, so, for example, there are no exposed electrical areas and no possibility of leaking current.

In the second preferred electrical embodiment of the present invention, as in the first preferred embodiment, the stop means 68 in the form of rubber bumpers 70 are used only under unusually heavy off balanced load conditions. As in the first embodiment, in the second embodiment, the bumpers 70 are positioned outside the exterior perimeter 74 of the tub 16 at a calculated movement allowance from the at rest centered tub position to limit the outward motion of the suspended core 26 so that centrifugal force will not pull the contact points 98 and 88 past the neutral or upright position of the washing machine 10, as seen in FIG. 1. In the second preferred embodiment, the contact unit 86 slides inwardly in its housing 92 by compressing the spring 112 as seen in FIG. 6. For the most part, the contact unit 86 has ample sliding area within its housing 92 to accommodate most unbalanced conditions. In the event of an unusually heavy off balance load, the bumpers 70 are positioned to limit the outward movement of the spin drum 18 of the washer 10, consequently preventing damage to the contact unit 86 and the stationary ring 80.

The second preferred electrical embodiment of the present invention is also equipped with the adjustable spring mechanism 77, as seen in FIG. 1, used to replace the existing springs 28 of the washing machine 10, to thereby provide a stronger and adjustable spring mechanism 77 to keep the suspended core 26 from swinging too forcefully against the stop from swinging too forcefully against the stop means 68.

From the foregoing it is apparent that other methods of dumping water from the cells could easily be incorporated within the spirit and scope of the invention. Therefore the preferred embodiments above have been given by way of illustration only and are not intended to limit the scope of the invention.

I claim:

1. A balancing system for an upright washing machine, the washing machine having a tub with a rim, a perforated spin drum with a perimeter positioned within the tub, a suspended core, springs for absorbing vibration, and washing water within, comprising:

liquid holding means attached to the perimeter of the spin drum for holding liquid at a location separate from the washing water in the tub of the washing machine;

liquid filling means attached to the liquid holding means for filling the liquid holding means;

liquid dumping means attached to the liquid holding means for dumping a filled liquid holding means;

balancing means attached to the liquid holding means for activating the dumping means;

a contact means attached to the balancing means for causing contact between the balancing means and the liquid dumping means; and whereby when the suspended core of the washing machine leans off center in response to an unbalanced load, the balancing means is contracted causing the contact means on the balancing means to contact the dumping means thereby releasing liquid to balance the load.

2. The balancing system for an upright washing machine as defined in claim 1 wherein the liquid filling means is a water filling means, filled by water from a pre-existing water nozzle of the washing machine.

3. The balancing system for an upright washing machine as defined in claim 1 wherein the liquid holding means is a plurality of self contained cells.

4. The balancing system for an upright washing machine as defined in claim 3 wherein the cells are positioned equidistantly around the rim of the spin drum of the washing machine.

5. The balancing system for an upright washing machine as defined in claim 1 wherein the filling means is a channel having liquid filling slots that fill the liquid holding means.

6. The balancing system for an upright washing machine as defined in claim 1 wherein the dumping means is a valve.

7. The balancing system for an upright washing machine as defined in claim 6 wherein the valve of the dumping means is mechanical, the balancing means is a stationary ring, and the contact means causes mechanical contact between the balancing means and the dumping means.

8. The balancing system for an upright washing machine as defined in claim 7 wherein the contact means is a mechanical arm that contacts the stationary ring causing an inner portion of the stationary ring to rotate thereby activating the dumping means.

9. The balancing system for an upright washing machine as defined in claim 8 further comprising stop means for limiting the outward motion of the suspended core.

10. The balancing system for an upright washing machine as defined in claim 6, the washing machine further having a power supply circuit, and a timing mechanism with a spin cycle, wherein the valve of the dumping means is electrical, the balancing means is a stationary ring and the contact means causes electrical contact between the balancing means and the dumping means and wherein the power supply circuit of the washing machine is connected to a pre-existing location on the timing mechanism of the washing machine at the spin cycle.

11. The balancing system for an upright washing machine as defined in claim 10 further comprising stop means for limiting the outward motion of the suspended core.

12. The balancing system for an upright washing machine as defined in claim 11 further comprising:

an adjustable spring mechanism to replace the existing springs on the washing machine for keeping the suspended core from swinging forcefully against the stop means.

13. The balancing system for an upright washing machine as defined in claim 1 wherein the balancing means is a stationary ring.

14. A method for balancing the load in an upright washing machine, the washing machine having a tub with a rim, a perforated spin drum with a perimeter positioned within the tub, a suspended core, springs for absorbing vibrations, and washing water within, comprising the steps of:

providing a liquid holding means attached to the perimeter of the spin drum for holding liquid at a location separate from the washing water in the tub of the washing machine;

providing liquid filling means attached to the liquid holding means for filling the liquid holding means;

providing liquid dumping means attached to the liquid holding means for dumping a filled liquid holding means;

providing balancing means attached to the liquid holding means for activating the dumping means;

providing a contact means attached to the balancing means for causing contact between the balancing means and the liquid dumping means;

causing the contact means on the balancing means to contact the dumping means in response to an unbalanced load thereby releasing liquid to balance the load.

15. The method for balancing the load in an upright washing machine as defined in claim 14 wherein the liquid filling means is a water filling means filled by water from a preexisting water nozzle of the washing machine.

16. The method for balancing the load in an upright washing machine as defined in claim 14 wherein the liquid holding means is a plurality of self contained cells.

17. The method for balancing the load in an upright washing machine as defined in claim 14 wherein the filling means is a channel having liquid filling slots that fill the liquid holding means.

18. The method for balancing the load in an upright washing machine as defined in claim 14 wherein the dumping means is a valve.

19. The method for balancing the load in an upright washing machine as defined in claim 18 wherein the valve of the dumping means is mechanical.

20. The method for balancing the load in an upright washing machine as defined in claim 18 wherein the valve of the dumping means is electrical.

* * * * *